United States Patent [19]

Kato et al.

[11] Patent Number: 4,610,957

[45] Date of Patent: Sep. 9, 1986

[54] HEAT-DEVELOPABLE LIGHT-SENSITIVE MATERIAL

[75] Inventors: Masatoshi Kato; Hiroshi Kitaguchi, both of Kanagawa, Japan

[73] Assignee: Fuji Photo Film Co., Ltd., Kanagawa, Japan

[21] Appl. No.: 727,718

[22] Filed: Apr. 26, 1985

[30] Foreign Application Priority Data

Apr. 27, 1984 [JP] Japan ..... 59-85834

[51] Int. Cl.[4] ..... G03C 1/02

[52] U.S. Cl. ..... 430/542; 430/619; 430/620; 430/203; 430/955; 430/957; 430/351; 430/617; 430/353; 430/544; 430/552; 430/553; 430/554; 430/555; 430/556; 430/557; 430/558; 430/559; 430/562

[58] Field of Search ..... 430/619, 620, 203, 955, 430/957, 351, 617, 353, 542, 544, 552, 553, 554, 555, 556, 557, 558, 559, 562

[56] References Cited

U.S. PATENT DOCUMENTS 4,511,650 4/1985 Hirai et al. ..... 430/955

4,535,056 8/1985 Frenchik ..... 430/619

*Primary Examiner*—Won H. Louie

*Attorney, Agent, or Firm*—Sughrue, Mion, Zinn, Macpeak, and Seas

[57] ABSTRACT

A heat-developable light-sensitive material comprising a support having thereon at least one light-sensitive silver halide emulsion and an acid precursor having a structural moiety represented by the following formula (I) bonded to carbon atoms:

(I)

The acid precursor is extremely stable at room temperature but when it is heated above a certain temperature, and the development proceeds to the desired appropriate condition, it releases an acid to neutralize a base, whereby the development is stopped. A heat-developable light-sensitive material containing the acid precursor provides color images having a high S/N ratio and a high image density.

20 Claims, No Drawings

HEAT-DEVELOPABLE LIGHT-SENSITIVE MATERIAL

FIELD OF THE INVENTION

The present invention relates to a heat-developable light-sensitive material, particularly to a heat-developable light-sensitive material which has stable photographic properties after development processing.

BACKGROUND OF THE INVENTION

Photographic processes using silver halide have been widely used in the past due to their excellent photographic properties such as sensitivity or control of gradation, etc., as compared with other photographic processes, such as an electrophotographic process or a diazo photographic process. In recent years, with respect to image formation processes for light-sensitive materials using silver halide, many techniques capable of easily and quickly providing images have been developed by changing the conventional wet process using a developing solution into a dry development process such as a process using heat, etc.

Heat-developable light-sensitive materials are thus well known in this field. Heat-developable light-sensitive materials and processes therefor have been described, for example, in *Shashin Kogaku no Kiso* (*The Foundation of Photographic Technology*), pages 553–555 (published by Corona Co., 1979), *Eizo Joho* (*The Image Information*), page 40 (April, 1978), *Nebletts Handbook of Photography and Reprography*, 7th Ed., pages 32–33 (Van Nostrand Reinhold Company), U.S. Pat. Nos. 3,152,904, 3,301,678, 3,392,020 and 3,457,075, British Pat. Nos. 1,131,108 and 1,167,777, and *Research Disclosure*, No. 17029, pages 9–15 (June, 1978).

Many different processes for obtaining color image have been proposed. With respect to processes for forming color codes by the reaction of an oxidation product of a developing agent with a coupler, it has been proposed to use a p-phenylenediamine type reducing agent and a phenolic coupler or an active methylene coupler as described in U.S. Pat. No. 3,531,286, a p-aminophenol type reducing agent as described in U.S. Pat. No. 3,761,270, a sulfonamidophenol type reducing agent as described in Belgian Pat. No. 802,519 and *Research Disclosure*, pages 31–32 (Sept., 1975) and the combination of a sulfonamidophenol type reducing agent and a 4-equivalent coupler as described in U.S. Pat. No. 4,021,240.

Also, processes and materials for forming a positive color image by a light-sensitive silver dye bleach process are described, for example, in *Research Disclosure*, No. 14433, pages 30–32 (April, 1976), *ibid.*, No. 15227, pages 14-15 (December, 1976) and U.S. Pat. No. 4,235,957, etc.

Further, processes for forming images upon heat-development utilizing compounds having a dye moiety which are capable of releasing a mobile dye in correspondence or counter-correspondence to the reduction reaction of silver halide to silver under temperature conditions have been described, for example, in European Patent Application (OPI) Nos. 76,492 and 79,056, Japanese Patent Application (OPI) Nos. 28928/83 and 26008/83, etc. (the term "OPI" as used herein refers to a "published unexamined patent application open to public inspection").

With these heat-develoapble light-sensitive materials development is conducted by heating. However, light-sensitive materials once heated at high temperature take a substantial time to decrease in temperature, resulting in overdevelopment or deterioration of image quality. Further, it is possible for development to occur beyond the desired level depending on subtle variations in conditions such as ambient temperature, temperature of heating, moisture content of the light-sensitive material, time of heating, etc., even when the same pattern of heating is employed.

In order to eliminate such a phenomenon in the similar techniques, it has been proposed to use compounds which react with an alkali material to release a development stopping agent as described in U.S. Pat. No. 4,009,029, or acid polymers for neutralization as described in *Research Disclosure*, Vol. 123, page 22, *ibid.*, Vol. 180, page 18030 and British Pat. No. 2,082,787A. In heat-developable light-sensitive materials, however, the former do not effectively stop development and the latter cause a reduction in the density of the image obtained because the bases are rapidly neutralized.

The most effective development stopping means conceivable is to perform development in the presence of a compound which releases an acid at an appropriate time of development to neutralize the base which promotes development, thus stopping development. Very few compounds are known, however, which release acids when heated. For example, in Japanese Patent Application (OPI) Nos. 58642/74 and 57452/75, there are disclosed acid components which at a temperature of at least 60° C. are dissolved or release volatile acids. However, since the compounds disclosed in these patent applications neutralize the bases before development is started by heating, development is restrained and the density of the image obtained is reduced.

SUMMARY OF THE INVENTION

It is an object of the present invention to provide a novel heat-developable light-sensitive material which has the effect of stopping development when the development has sufficiently proceeded without reducing density of the resulting image.

More specifically, one object of the present invention is to provide a heat-developable light-sensitive material containing a novel acid precursor which is extremely stable at room temperature but when it is heated above a certain temperature development proceeds till the appropriate condition whereupon it releases an acid to neutralize a base and stop development.

Another object of the present invention is to provide a heat-developable light-sensitive material which provides an image having a high S/N ratio and high image density.

Other objects of the present invention will become apparent from the following detailed description and examples.

These objects of the present invention are achieved by a heat-developable light-sensitive material comprising a support having thereon at least light-sensitive silver halide emulsion and an acid precursor having a structural moiety represented by the following formula (I) bonded to carbon atoms.

$$-\overset{\overset{\displaystyle O}{\|}}{C}-NH-O-\overset{\overset{\displaystyle O}{\|}}{C}- \qquad (I)$$

DETAILED DESCRIPTION OF THE INVENTION

Of the acid precursors according to the present invention, those preferred are represented by the following general formula (A):

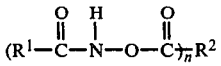

wherein $R^1$ represents a group selected from an alkyl group including a substituted alkyl group, a cycloalkyl group including a substituted cycloalkyl group, an aralkyl group including a substituted aralkyl group, an alkenyl group including a substituted alkenyl group, an aryl group including a substituted aryl group and a heterocyclic group including a substituted heterocyclic group; $R^2$ represents a mono-, di- or trivalent residue selected from an alkyl group including a substituted alkyl group, a cycloalkyl group including a substituted cycloalkyl group, an aralkyl group including a substituted aralkyl group, an aryl group including a substituted aryl group, a heterocyclic group including a substituted heterocyclic group and a group formed by combining the foregoing groups; and n represents an integer of 1, 2 or 3.

In $R^1$ and $R^2$, a preferred alkyl group is a straight chain or branched chain alkyl group having from 1 to 18 carbon atoms. Specific examples include an ethyl group, an n-propyl group, an n-butyl group, an n-hexyl group, an n-heptyl group, a 2-ethylhexyl group, an n-decyl group, an n-dodecyl group, etc. Substituents on the substituted alkyl group include, for example, a halogen atom, an alkoxy group, a cyano group, a substituted or unsubstituted carbamoyl group, a hydroxyl group, a carboxyl group, etc.

In $R^1$ and $R^2$, a preferred cycloalkyl group is a 5-membered or 6-membered unsubstituted or substituted cycloalkyl group having from 5 to 10 carbon atoms. Specific examples include a cyclopentyl group, a cyclohexyl group, etc.

Specific examples of the aralkyl groups include a benzyl group, a $\beta$-phenethyl group, etc.

Specific examples of the alkenyl groups include a vinyl group, an allyl group, a crotyl group, a substituted or unsubstituted styryl group, etc.

In $R^1$ and $R^2$, a preferred aryl group is an aryl group having from 6 to 18 carbon atoms. Specific examples include a phenyl group, a naphthyl group, an anthryl group, etc. Substituents on the substituted aryl group include, for example, a substituted or unsubstituted alkyl group, a substituted or unsubstituted alkoxy group, a substituted or unsubstituted aryl group, a halogen atom, a hydroxy group, a mercapto group, an amino group, a substituted amino group substituted with an alkyl group or an aryl group, an acylamino group, a sulfonylamino group, a cyano group, a nitro group, an alkyl- or arylthio group, an alkyl- or arylsulfonyl group, an oxycarbonyl group, a carbonyloxy group, a substituted or unsubstituted carbamoyl group, a substituted or unsubstituted sulfamoyl group, etc.

In $R^1$ and $R^2$, specific examples of the heterocyclic group include a pyridyl group, a furyl group, a thienyl group, a pyrrole group, an indolyl group, etc. The heterocyclic group may be substituted with the substituents defined for the above-described substituted aryl group.

Of the above-described groups for $R^1$ and $R^2$, an aryl group, a substituted aryl group and a heterocyclic group are preferred, and further a phenyl group, a substituted phenyl group, a naphthyl group and a substituted naphthyl group are particularly preferred.

When heated at a temperature of higher than 60° C., preferably higher than 100° C., the acid precursor according to the present invention undergoes Lossen rearrangement to release a carboxylic acid in accordance with the following reaction scheme.

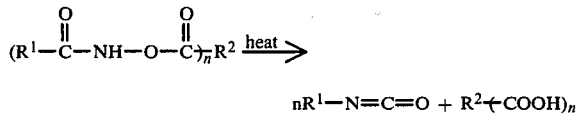

The reaction described above proceeds only by heating and is greatly accelerated in the presence of a base. The acids released form salts of carboxylic acids together with the bases, whereby a neutralization function is achieved as illustrated in the following scheme.

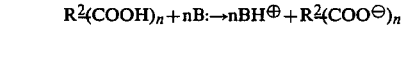

wherein B: represents a base.

It is known that potassium salts of the compounds represented by general formula (A) undergo Lossen rearrangement to provide salts of carboxylic acids. Investigations regarding the chemical kinetics of the reaction have been made in greater detail as described, for example, in *Journal of American Chemical Society*, Vol. 59, page 2308 (1937), *ibid.*, Vol. 61, page 618 (1939), etc.

However, it has now been found for the first time that the compounds represented by general formula (A) function as effective acid precursors which are extremely stable at room temperature and, when heated in the presence of a base, efficiently release acids. These compounds are particularly effective as acid precursors employed in heat-developable light-sensitive materials the development of which is accelerated upon the release of bases from base precursors by heating, since they are stable at room temperature (due to the absence of a base) but when heated, they undergo a reaction to release acids which is accelerated by the base(s) released by the heating and form carboxylic acid salts of the bases, whereby the desired neutralization function is achieved.

Specific examples of the acid precursors according to the present invention are shown below. The present invention, however, is not to be construed as being limited to these specific examples.

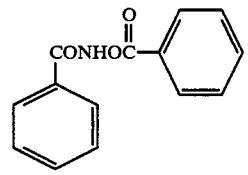

(1)

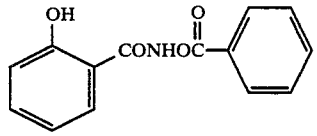

(2)

-continued
(3)
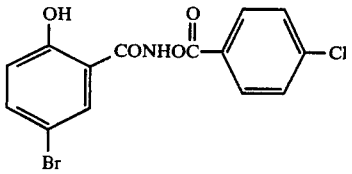
(4)
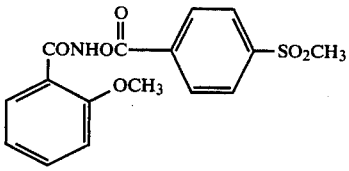
(5)
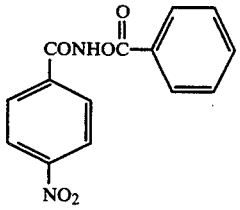
(6)
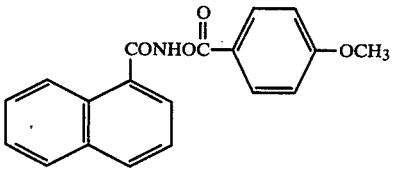
(7)
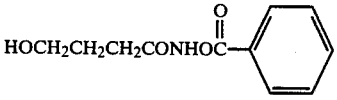
(8)
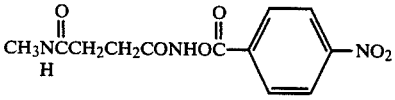
(9)
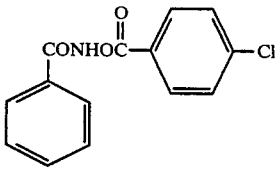
(10)
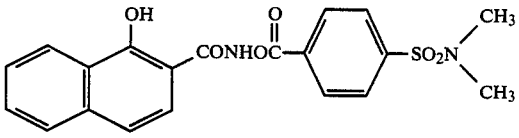
(11)
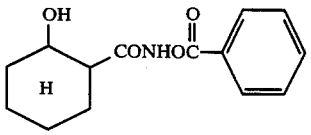
(12)
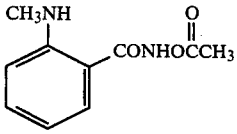
-continued
(13)
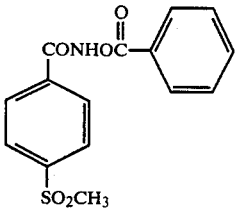
(14)
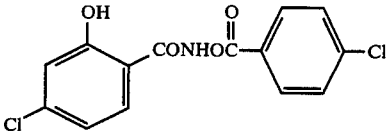
(15)
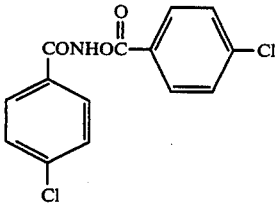
(16)
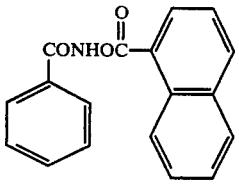
(17)
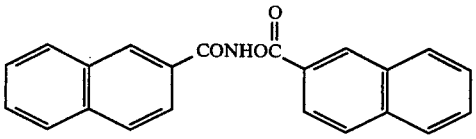
(18)
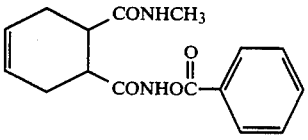
(19)
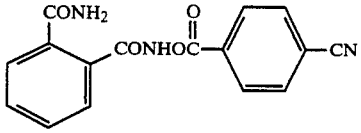
(20)
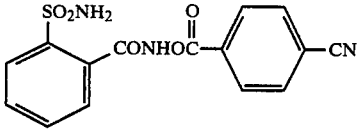
(21)
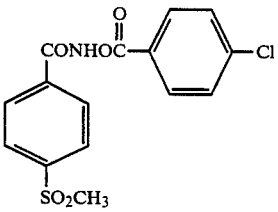

-continued
(22)
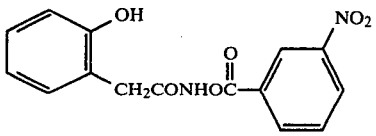
(23)
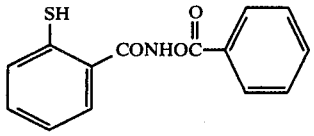
(24)
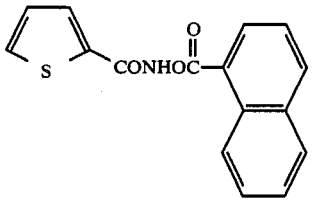
(25)
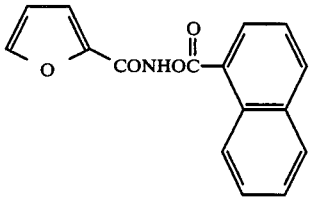
(26)
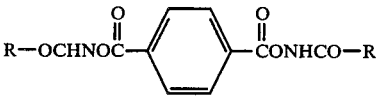
wherein R represents
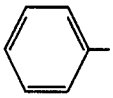
(27)
Same as (26) except that R represents
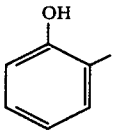
(28)
Same as (26) except that R represents
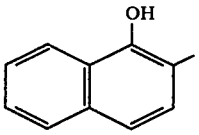
(29)
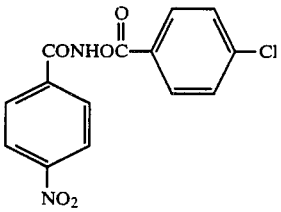
-continued
(30)
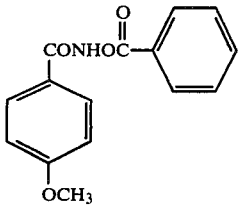
(31)
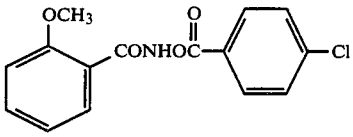
(32)
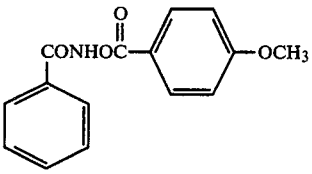
(33)
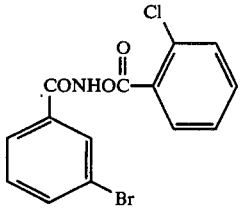
(34)
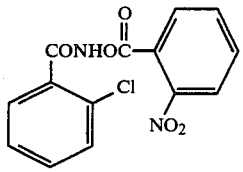
(35)
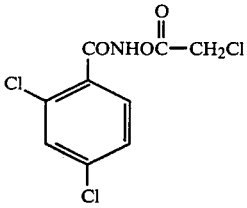
(36)
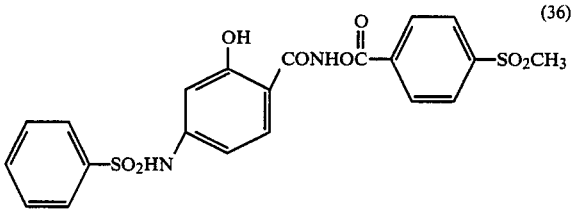
(37)
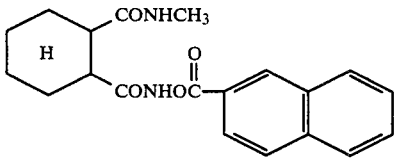

-continued (38)

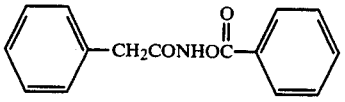

(39)

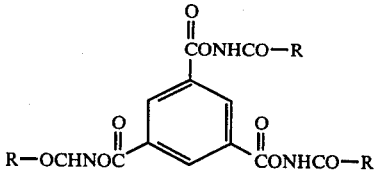

wherein R represents 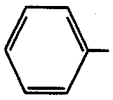

Same as (39) except that R represents 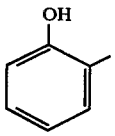

(41)

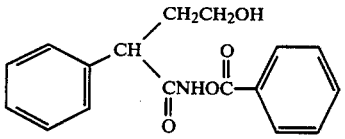

(42)

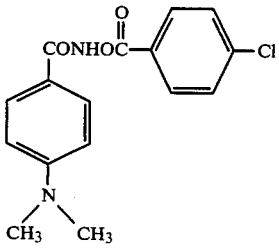

(43)

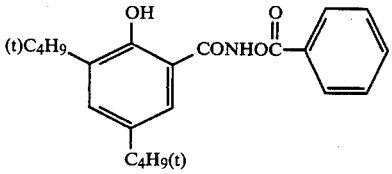

(44)

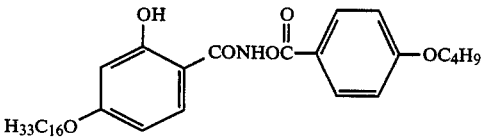

(45)

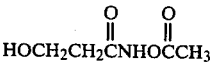

(46)

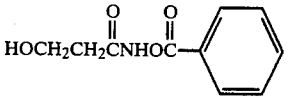

-continued (47)

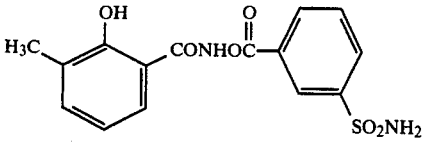

Methods for syntheses of the acid precursors according to the present invention will be described below.

The acid precursors according to the present invention can be synthesized by the condensation reaction of hydroxamic acid derivatives or salts thereof (C) with carboxylic acid halides as illustrated in the following reaction scheme.

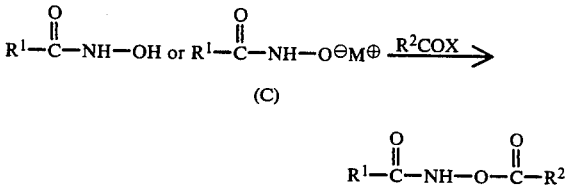

wherein X represents a halogen atom; $M^{\oplus}$represents $K^{\oplus}$, $Na^{\oplus}$, etc., and $R^1$ and $R^2$ each has the same meaning as earlier defined.

The reaction of hydroxamic acid derivatives or salts thereof with carboxylic acid halides can be carried out using various solvents. Of the solvents, acetonitrile, N,N-dimethylacetamide, N,N-dimethylformamide, etc., are particularly preferred because of the rapidity of reaction and the high yield.

The hydroxamic acid derivatives or metal salts thereof used can be obtained by reaction of the corresponding carboxylic acid esters (D) with free hydroxylamine as described, for example, in *Journal of American Chemical Society*, Vol. 59, page 2308 (1937), and *ibid.*, Vol. 61, page 618 (1939), etc., illustrated by the following reaction scheme.

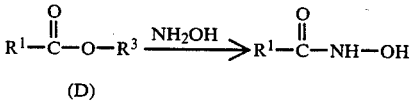

wherein $-R^3$ represents $-CH_3$, $-CH_2CH_3$,

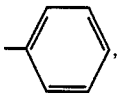

etc.; and $R^1$ has the same meaning as earlier defined.

Specific synthesis examples of the acid precursors are set forth below. Unless otherwise indicated, all parts, percents, ratios and the like are by weight.

SYNTHESIS EXAMPLE 1

Synthesis of Acid Precursor (1)

To 100 ml of an acetonitrile solution containing 25 g (0.182 mol) of benzohydroxamic acid was dropwise added 26 g (0.185 mol) of benzoyl chloride, and then the mixture was refluxed by heating for 2 hours. After the completion of the generation of hydrogen chloride gas, the reaction mixture was cooled with ice. The crystals thus precipitated were collected by filtration and washed with acetonitrile to obtain 38.7 g (0.16 mol) of Acid Precursor (1).

SYNTHESIS EXAMPLE 2

Synthesis of Acid Precursor (29)

100 ml of an acetonitrile solution containing 20 g (0.091 mol) of potassium p-nitrobenzohydroxamate was cooled to 10° C. and, while maintaining this temperature, 16 g (0.091 mol) of p-chlorobenzoyl chloride was dropwise added thereto. After the completion of the dropwise addition, the mixture was stirred at room temperature for 30 minutes and then refluxed by heating for 20 minutes. The reaction mixture was poured into water and the crystals thus precipitated were collected by filtration. These crude crystals were recrystallized from ethyl acetate to obtain 11.1 g (0.035 mol) of Acid Precursor (29).

SYNTHESIS EXAMPLE 3

Synthesis of Acid Precursor (21)

Synthesis of methyl p-methylsulfonylbenzoate:

250 ml of a desiccated methanol solution containing 50 g (0.25 mol) of p-methylsulfonylbenzoic acid and 10 ml of concentrated sulfuric acid was refluxed by heating for 8 hours. The reaction mixture was then cooled with ice and the crystals thus precipitated were collected by filtration and washed with methanol to obtain 48.2 g (0.225 mol) of the above described compound.

Synthesis of p-methylsulfonylbenzohydroxamic acid:

To 140 ml of a methanol solution containing 27.4 g (0.4 mol) of hydroxylamine hydrochloride was dropwise added 77 g (0.4 mol) of a 28% methanol solution of sodium methylate with stirring. After the completion of the dropwise addition, the mixture was cooled with ice and the inorganic salt thus precipitated was removed by filtration to prepare a methanol solution of the free hydroxylamine. To this solution was added 21.4 g (0.1 mol) of methyl p-methylsulfonylbenzoate and the mixture was stirred at 55° to 60° C. for 1 hour while bubbling nitrogen gas therethrough and then refluxed for 3 hours. Then, the reaction mixture was cooled with ice and the crystals thus precipitated were collected by filtration. These crude crystals were recrystallized from water to obtain 5.3 g (0.0247 mol) of the above described compound.

Synthesis of Acid Precursor (21):

30 ml of an acetonitrile solution containing 5.3 g (0.0247 mol) of p-methylsulfonylbenzohydroxamic acid obtained as described above and 4.4 g (0.025 mol) of p-chlorobenzoyl chloride was refluxed by heating for 2 hours. The reaction mixture was then cooled with ice and the crystals thus precipitated were collected by filtration and washed with acetonitrile to obtain 6.5 g (0.0184 mol) of Acid Precursor (21).

In the following, the melting points of several examples of the acid precursors are given.

| Acid Precursor | Melting Point (°C.) |
|---|---|
| (1) | 155 to 156 |
| (2) | 143 to 144.5 |
| (9) | 133 to 133.5 |
| (15) | 161 to 162 |
| (21) | 174 to 176 |
| (29) | 174.5 |

-continued

| Acid Precursor | Melting Point (°C.) |
|---|---|
| (32) | 134 to 135 |

The acid precursors according to the present invention generate acid efficiently while they are present in a substantially dry film. Accordingly, the acid precursors according to the present invention are advantageously used for inducing a chemical change by the acids generated upon heating.

The amount of the acid precursors used in the present invention varies depending upon the specific precursor used and the system in which it is used, but it is generally not more than about 50% by weight, preferably not more than about 30% by weight and less than about 0.01% by weight, based on the total weight of the coating layers on the support. The acid precursors according to the present invention can be used either singly or in combination with each other.

The acid precursors according to the present invention can be incorporated into a binder by dissolving them in a water-soluble organic solvent (such as methanol, ethanol, acetone, dimethylformamide, etc.) or a mixture of the organic solvent(s) and water.

The acid precursors according to the present invention can also be incorporated in the form of fine particles into a binder.

The acid precursors are preferably added to an emulsion layer or an intermediate layer.

Preferred acid precursors according to the present invention are those which decompose not more than 80%, preferably not more than 50%, and more preferably not more than 20%, based on the total amount thereof present until the appropriate time when development has sufficiently proceeded without reducing density of the resulting images (at the time just before fog abruptly increases).

In the present invention, it is particularly preferred to use various bases or base precursors as dye releasing assistants.

The bases or precursors thereof can be used in a light-sensitive material and/or a dye fixing material. In the case of incorporating them in a light-sensitive material, it is particularly advantageous to use base precursors, and to add them to the layer containing the acid precursors or a layer adjacent to the layer containing the acid precursors. The term "base precursor" used herein means a substance which releases a base component by heating to a temperature of development, where the base component released may be any inorganic base or organic base.

As examples of preferred bases, there are, as inorganic bases, hydroxides, secondary or tertiary phosphates, borates, carbonates, quinolinates and metaborates of alkali metals or alkaline earth metals; ammonium hydroxide; quaternary alkylammonium hydroxide; and other metal hydroxides; etc., and, as organic bases, aliphatic amines, aromatic amines, heterocyclic amines, amidines, cyclic amidines, guanidines, cyclic guanidines, etc. In the present invention, compounds having a pKa value of 8 or more are particularly useful.

As the base precursors, substances which undergo reaction by heating to release a base, such as salts of an organic acid which is decarboxylated by heating to undergo decomposition and yield a base, or compounds which are decomposed by Lossen rearrangement or Beckmann rearrangement to release an amine, are used.

As preferred base precursors, there are precursors of the above described organic bases. For example, there are salts of thermally decomposable organic acids such as trichloroacetic acid, propiolic acid, cyanoacetic acid, sulfonylacetic acid, acetoacetic acid, etc., and salts of 2-carboxycarboxamide as described in U.S. Pat. No. 4,088,496, etc.

Specific examples of preferred bases are set forth below, but the present invention should not be construed as being limited to these compounds.

Lithium hydroxide, sodium hydroxide, potassium hydroxide, barium hydroxide, sodium carbonate, potassium carbonate, sodium quinolinate, potassium quinolinate, sodium secondary phosphate, potassium secondary phosphate, sodium tertiary phosphate, potassium tertiary phosphate, sodium pyrophosphate, potassium pyrophosphate, sodium metaborate, potassium metaborate, borax, ammonium hydroxide, tetramethyl ammonium, tetrabutyl ammonium, ammonia, $MeNH_2$ (Me represents $CH_3$ hereinafter), $Me_2NH$, $EtNH_2$ (Et represents $C_2H_5$ hereinafter), $Et_2NH$, $C_4H_9NH_2$, $(C_4H_9)_2NH$, $HOC_2H_4NH_2$, $(HOC_2H_4)_2NH$, $Et_2NCH_2CH_2OH$, $H_2NC_2H_4NH_2$, $MeNHC_2H_4NHMe$, $Me_2NCH_4NH_2$, $H_2NC_3H_6NH_2$, $H_2NC_4H_8NH_2$, $H_2NC_5H_{10}NH_2$, $Me_2NC_2H_4NMe_2$, $Me_2NC_3H_6NMe_2$,

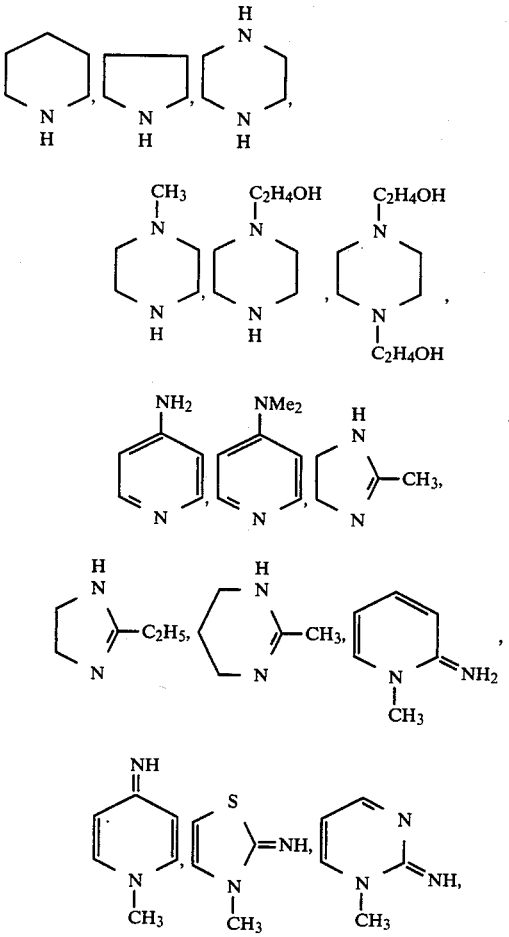

-continued

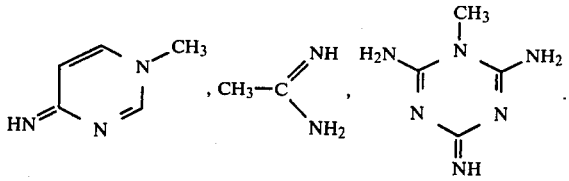

Specific examples of preferred base precursors are set forth below, but the present invention should not be construed as being limited thereto.

As trichloroacetic acid derivatives, there are guanidine trichloroacetic acid, piperidine trichloroacetic acid, morpholine trichloroacetic acid, p-toluidine trichloroacetic acid, 2-picoline trichloroacetic acid, etc. These compounds are believed to release a base by decarboxylation of the acid moiety.

In addition, base precursors as described in British Pat. No. 998,945, U.S. Pat. No. 3,220,846, Japanese Patent Application (OPI) No. 22625/75, etc., can be used.

As substances besides trichloroacetic acids, there are 2-carboxycarboxamide derivatives as described in U.S. Pat. No. 4,088,496, α-sulfonylacetate derivatives as described in U.S. Pat. No. 4,060,420, salts of propiolic acid derivatives and bases as described in Japanese Patent Application No. 55700/83, etc. Salts using alkali metal or an alkaline earth metal as a base component other than organic bases are also effective.

As other precursors, hydroxamic carbamates as described in Japanese Patent Application No. 43860/83 utilizing Lossen rearrangement and aldoxime carbamates as described in Japanese Patent Application No. 31614/83 which form a nitrile, etc., are effective.

Further, amineimides as described in *Research Disclosure,* No. 15776 (May, 1977) and aldonic amides as described in Japanese Patent Application (OPI) No. 22625/75 are suitably used, because they form a base by decomposition at a high temperature.

These bases and base precursors can be used over a wide range. An effective range is not more than 50% by weight based on the total weight of the dried coating layers on the support in the light-sensitive material, and, preferably, a range of from 0.01% by weight to 40% by weight.

According to the present invention, silver can be utilized as an image forming substance. Further, various other image forming substances can be employed in various image forming processes.

For instance, couplers capable of forming color images upon reaction with an oxidation product of a developing agent which are used in liquid development processing widely known hitherto can be employed. For example, as magenta couplers, there are 5-pyrazolone couplers, pyrazolobenzimidazole couplers, cyanoacetylcoumarone couplers and open chain acylacetonitrile couplers, etc. As yellow couplers, there are acylacetamide couplers (for example, benzoylacetanilides and pivaloylacetanilides), etc. As cyan couplers, there are naphthol couplers and phenol couplers, etc. It is preferred that these couplers be nondiffusible substances which have a hydrophobic group called a ballast group in the molecule thereof or be polymerized substances. The couplers may be any of the 4-equivalent type and 2-equivalent type to silver ions. Further, they may be colored couplers having a color correction effect or couplers which release a development inhibitor at development processing (so-called DIR couplers).

Further, dyes for forming positive color images by a light-sensitive silver dye bleach processes, for example, those as described in *Research Disclosure,* No. 14433, pages 30–32 (April, 1976), ibid., No. 15227, pages 14–15 (December, 1976) and U.S. Pat. No. 4,235,957, etc., can be employed.

Moreover, leuco dyes as described, for example, in U.S. Pat. Nos. 3,985,565 and 4,022,617, etc., can be used.

Further, dyes to which a nitrogen-containing heterocyclic group have been introduced as described in *Research Disclosure,* No. 16966, pages 54–58 (May, 1978), may be employed.

In addition, dye providing substances which release a mobile dye by utilizing a coupling reaction of a reducing agent oxidized by an oxidation reduction reaction with a silver halide or an organic silver salt at high temperature as described in European Pat. No. 79,056, West German Pat. No. 3,217,853, European Pat. No. 67,455, etc., and dye providing substances which release a mobile dye as a result of an oxidation reduction reaction with a silver halide or an organic silver salt at high temperature as described in European Pat. No. 76,492, West German Pat. No. 3,215,485, European Pat. No. 66,282, Japanese Patent Application Nos. 28928/83 and 26008/83, etc., can be employed.

Thus, the term "reducing substance" as used herein includes dye providing substances and reducing agents, the latter being described herein below.

Preferred dye providing substances which can be employed in these processes can be represented by the following general formula (CI):

$$(\text{Dye}—X)_q Y \qquad \text{(C I)}$$

wherein Dye represents a dye which becomes mobile when it is released from the molecule of the compound represented by the general formula (C I); X represents a simple bond or a connecting group; Y represents a group which releases Dye in correspondence or countercorrespondence to light-sensitive silver salts having a latent image distributed imagewise, the diffusibility of Dye released being different from that of the compound represented by formula (C I) and q represents an integer of 1 or 2.

The dye represented by Dye is preferably a dye having a hydrophilic group. Examples of the dye which can be used include azo dyes, azomethine dyes, anthraquinone dyes, naphthoquinone dyes, styryl dyes, nitro dyes, quinoline dyes, carbonyl dyes and phthalocyanine dyes, etc. These dyes can also be used in the form of having temporarily shorter wavelengths, the color of which is recoverable in the development processing.

More specifically, the dyes as described in European Patent Application No. 76,492 can be utilized.

Examples of the connecting group represented by X include —NR— (wherein R represents a hydrogen atom, an alkyl group, or a substituted alkyl group), —$SO_2$—, —CO—, an alkylene group, a substituted alkylene group, a phenylene group, a substituted phenylene group, a naphthylene group, a substituted naphthylene group, —O—, —SO—, or a group derived by combining together two or more of the foregoing groups.

In the following, preferred embodiments of Y in formula (C I) are described in greater detail.

In one embodiment, Y is selected so that the compound represented by the general formula (C I) is a nondiffusible image forming compound which is oxidized as a result of development, thereby undergoing self-cleavage and releasing a diffusible dye.

An example of Y which is effective for compounds of this type is an N-substituted sulfamoyl group. For example, a group represented by formula (C II) is illustrated for Y.

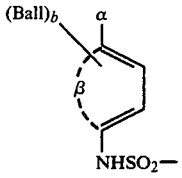

(C II)

wherein $\beta$ represents non-metallic atoms necessary for forming a benzene ring, which may optionally be fused with a carbon ring or a hetero ring to form, for example, a naphthalene ring, a quinoline ring, a 5,6,7,8-tetrahydronaphthalene ring, a chroman ring or the like.

$\alpha$ represents a group of —$OG^{11}$ or —$NHG^{12}$ (wherein $G^{11}$ represents hydrogen or a group which forms a hydroxy group upon being hydrolyzed, and $G^{12}$ represents hydrogen, an alkyl group containing 1 to 22 carbon atoms or a hydrolyzable group), Ball represents a ballast group, and b represents an integer of 0, 1 or 2.

Specific examples of this type of Y are described in Japanese Patent Application (OPI) Nos. 33826/73 and 50736/78.

Other examples of Y suited for this type of compound are those represented by the following general formula (CIII):

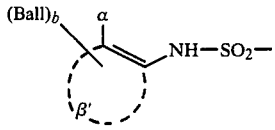

(CIII)

wherein Ball, $\alpha$, and b are the same as defined with (CII), $\beta'$ represents atoms necessary for forming a carbon ring (e.g., a benzene ring which may be fused with another carbon ring or a hetero ring to form a naphthalene ring, quinoline ring, 5,6,7,8-tetrahydronaphthalene ring, chroman ring or the like. Specific examples of this type of Y are described in Japanese Patent Application (OPI) Nos. 113624/76, 12642/81, 16130/81, 4043/82 and 650/82, and U.S. Pat. No. 4,053,312.

Further examples of Y suited for this type of compound are those represented by the following formula (CIV):

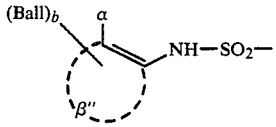

(CIV)

wherein Ball, $\alpha$, and b are the same as defined with the formula (CII), and $\beta''$ represents atoms necessary for forming a hetero ring such as a pyrazole ring, a pyridine ring or the like, said hetero ring being optionally bound to a carbon ring or a hetero ring. Specific examples of this type of Y are described in Japanese Patent Application (OPI) No. 104343/76.

Still further examples of Y suited for this type of compound are those represented by the following formula (CV):

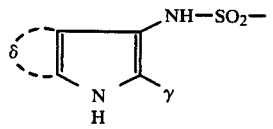

(CV)

wherein $\gamma$ preferably represent hydrogen, a substituted or unsubstituted alkyl, aryl or heterocyclic group, or —CO—$G^{21}$; $G^{21}$ represents —$OG^{22}$, —$SG^{22}$ or

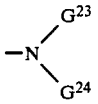

(wherein $G^{22}$ represents hydrogen, an alkyl group, a cycloalkyl group or an aryl group, $G^{23}$ is the same as defined for said $G^{22}$, or $G^{23}$ represents an acyl group derived from an aliphatic or aromatic carboxylic or sulfonic acid, and $G^{24}$ represents hydrogen or an unsubstituted or substituted alkyl group); and $\delta$ represents a residue necessary for completing a fused benzene ring.

Specific examples of this type of Y are described in Japanese Patent Application (OPI) Nos. 104343/76, 46730/78, 130122/79 and 85055/82.

Still further examples of Y suited for this type of compound are those represented by the formula (CVI):

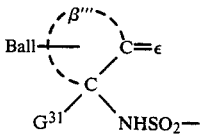

(CVI)

wherein Ball is the same as defined with the formula (CII); $\epsilon$ represents an oxygen atom or $=NG^{32}$ (wherein $G^{32}$ represents hydroxy or an optionally substituted amino group) (examples of $H_2N$—$G^{32}$ to be used for forming the group of $=NG^{32}$ including hydroxylamine, hydrazines, semicarbazides, thiosemicarbazides, etc.); $\beta'''$ represents a saturated or unsaturated nonaromatic 5-, 6- or 7-membered hydrocarbon ring; and $G^{31}$ represents hydrogen or a halogen atom (e.g., a fluorine atom, a chlorine atom, a bromine atom, etc.).

Specific examples of this type of Y are described in Japanese Patent Application (OPI) Nos. 3819/78 and 48534/79.

Other examples of Y of this type of compound are described in Japanese Patent Publication Nos. 32129/73, 39165/73, Japanese Patent Application (OPI) No. 64436/74, U.S. Pat. No. 3,443,934, etc.

Still further examples of Y are those represented by the following formula (CVII):

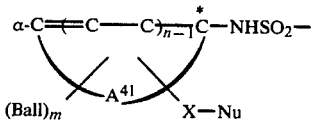

(CVII)

wherein $\alpha$ represents $OR^{41}$ or $NHR^{42}$; $R^{41}$ represents hydrogen or a hydrolyzable component; $R^{42}$ represents hydrogen or an alkyl group containing 1 to 50 carbon atoms; $A^{41}$ represents atoms necessary for forming an aromatic ring; Ball represents an organic immobile group existing on the aromatic ring, with Ball's being the same or different from each other; m represents an integer of 1 or 2; X represents a divalent organic group having 1 to 8 atoms, with the nucleophilic group (Nu) and an electrophilic center (asterisked carbon atom) formed by oxidation forming a 5- to 12-membered ring; Nu represents a nucleophilic group; n represents an integer of 1 or 2; and $\alpha$ may be the same as defined with the above-described formula (CII). Specific examples of this type of Y are described in Japanese Patent Application (OPI) No. 20735/82.

As still further type of examples represented by the formula of (CI), there are dye providing non-diffusible substances which release a diffusible dye in the presence of a base as a result of self cyliczation or the like but which, when reacted with an oxidation product of a developing agent, substantially never release the dye.

Examples of Y effective for this type of compound are those which are represented by the formula (CVIII):

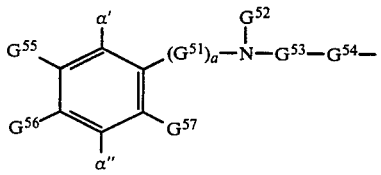

(CVIII)

wherein $\alpha'$ represents an oxidizable nucleophilic group (e.g., a hydroxy group, a primary or secondary amino group, a hydroxyamino group, a sulfonamido group or the like) or a precursor thereof;

$\alpha''$ represents a dialkylamino group or an optional group defined for $\alpha'$;

$G^{51}$ represents an alkylene group having 1 to 3 carbon atoms;

a represents 0 or 1;

$G^{52}$ represents a substituted or unsubstituted alkyl group having 1 to 40 carbon atoms or a substituted or unsubstituted aryl group having 6 to 40 carbon atoms;

$G^{53}$ represents an electrophilic group such as —CO—or —CS—;

$G^{54}$ represents an oxygen atom, a sulfur atom, a selenium atom, a nitrogen atom or the like and, when $G^{54}$ represents a nitrogen atom, it has hydrogen or may be substituted by an alkyl or substituted alkyl group having 1 to 10 carbon atoms or an aromatic residue having 6 to 20 carbon atoms; and $G^{55}$, $G^{56}$ and $G^{57}$ each represents hydrogen, a halogen atom, a carbonyl group, a sulfamyl group, a sulfonamido group, an alkyloxy group having 1 to 40 carbon atoms or an optional group defined for $G^{52}$, $G^{55}$ and $G^{56}$ may form a 5- to 7-membered ring, and $G^{56}$ may represent

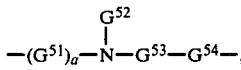

with the proviso that at least one of $G^{52}$, $G^{55}$, $G^{56}$ and $G^{57}$ represents a ballast group. Specific examples of this type of Y are described in Japanese Patent Application (OPI) No. 63618/76.

Further examples of Y suited for this type of compound are those which are represented by the following general formulae (CIX) and (CX):

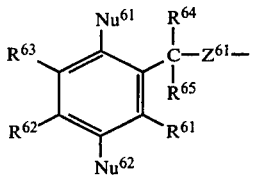

(CIX)

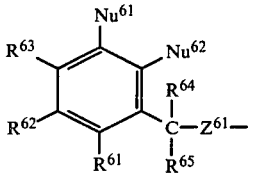

(CX)

wherein $Nu^{61}$ and $Nu^{62}$, which may be the same or different, each represents a nucleophilic group or a precursor thereof; $Z^{61}$ represents a divalent atom group which is electrically negative with respect to the carbon atom substituted by $R^{64}$ and $R^{65}$; $R^{61}$, $R^{62}$ and $R^{63}$ each represents hydrogen, a halogen atom, an alkyl group, an alkoxy group or an acylamino group or, when located at adjacent positions on the ring, $R^{61}$ and $R^{62}$ may form a fused ring together with the rest of the molecule, or $R^{62}$ and $R^{63}$ may form a fused ring together with the rest of the molecule; $R^{64}$ and $R^{65}$, which may be the same or different, each represents hydrogen, a hydrocarbon group or a substituted hydrocarbon group; with at least one of the substituents, $R^{61}$, $R^{62}$, $R^{63}$, $R^{64}$ and $R^{65}$ having a ballast group, Ball, of an enough size so as to render the above-described compounds immobile. Specific examples of this type of Y are described in Japanese Patent Application (OPI) Nos. 69033/78 and 130927/79.

Further examples of Y suited for this type of compound are those which are represented by the formula of (CXI):

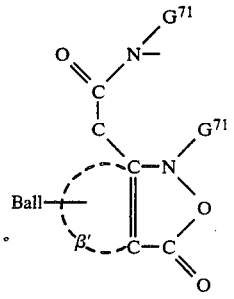

(CXI)

wherein

Ball and $\beta'$ are the same as defined for those in formula (CIII), and $G^{71}$ represents an alkyl group (including a substituted alkyl group). Specific examples of this type of Y are described in Japanese Patent Application (OPI) Nos. 111628/74 and 4819/77.

As different type of compound represented by the general formula (CI), there are illustrated dye providing nondiffusible substances which themselves do not release any dye but, upon reaction with a reducing agent, release a dye. With these compounds, compounds which mediate the redox reaction (called electron donors) are preferably used in combination.

Examples of Y effective for this type of compound are those represented by the formula (CXII):

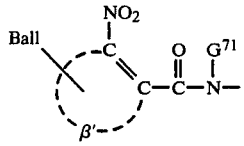

(CXII)

wherein Ball and $\beta'$ are the same as defined for those in the general formula (CIII), and $G^{71}$ represents an alkyl group (including a substituted alkyl group). Specific examples of this type of Y are described in Japanese Patent Application (OPI) Nos. 35533/78 and 110827/78.

Further examples of Y suited for this type of compound are those which are represented by (CXIII):

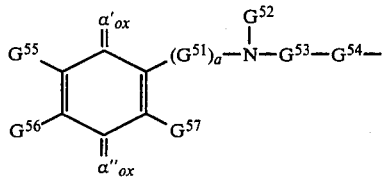

(CXIII)

wherein $\alpha'_{ox}$ and $\alpha''_{ox}$ represent groups capable of giving $\alpha'$ and $\alpha''$, respectively, upon reduction, and $\alpha'$, $\alpha''$, $G^{51}$, $G^{52}$, $G^{53}$, $G^{54}$, $G^{55}$, $G^{56}$, $G^{57}$ and a are the same as defined with respect to formula (CVIII). Specific examples of Y described above are described in Japanese Patent Application (OPI) No. 110827/78, U.S. Pat. Nos. 4,356,249 and 4,358,525.

Further examples of Y suited for this type of compound are those which are represented by the formulae (CXIVA) and (CXIVB):

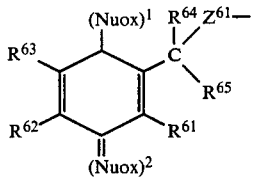

(CXIVA)

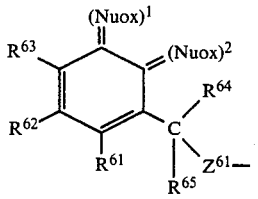

(CXIVB)

wherein $(Nuox)^1$ and $(Nuox)^2$, which may be the same or different, each represents an oxidized nucleophilic group, and other notations are the same as defined with respect to the formulae (CIX) and (CX). Specific examples of this type of Y are described in Japanese Patent Application (OPI) Nos. 130927/79 and 164342/81.

The publicly known documents having been referred to with respect to (CXII), (CXIII), (CXIVA) and (CXIVB) describe electron donors to be used in combination.

As still further different type of compound represented by the general formula (CI), there are illustrated LDA compounds (Linked Donor Acceptor Compounds). These compounds are dye providing non-diffusible substances which cause donor-acceptor reaction in the presence of a base to release a diffusible dye but, upon reaction with an oxidation product of a developing agent, they substantially do not release the dye any more.

Examples of Y effective for this type of compound are those represented by the formula of (CXV) (specific examples thereof being described in Japanese Patent Application (OPI) No. 60289/83):

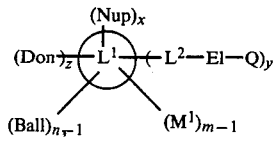

(CXV)

wherein n, x, y and z each represents 1 or 2, m represents an integer of 1 or more; Don represents a group containing an electron donor or its precursor moiety; $L^1$ represents an organic group linking Nup to —El—Q or Don; Nup represents a precursor of a nucleophilic group; El represents an electrophilic center; Q represents a divalent group; Ball represents a ballast group; $L^2$ represents a linking group; and $M^1$ represents an optional substituent.

The ballast group is an organic ballast group which can render the dye providing substance nondiffusible, and is preferably a group containing a $C_{8-32}$ hydrophobic group. Such organic ballast group is bound to the dye providing substance directly or through a linking group (e.g., an imino bond, an ether bond a thioether bond, a carbonamido bond, a sulfonamido bond, a ureido bond, an ester bond, an imido bond, a carbamoyl bond, a sulfamoyl bond, etc., and combination thereof).

Two or more kinds of the dye providing substances can be employed together. In such a case two or more kinds of the dye providing substances may be used together in order to provide the same hue or in order to reproduce black color.

Specific examples of dye image forming substrates which can be used in the present invention are described in the patents cited hereinbefore. Since length prevents illustrating all preferred examples thereof, only a portion thereof is described hereinafter. Specific examples of the dye providing substances represented by general formula (CI) are set forth below.

(1)

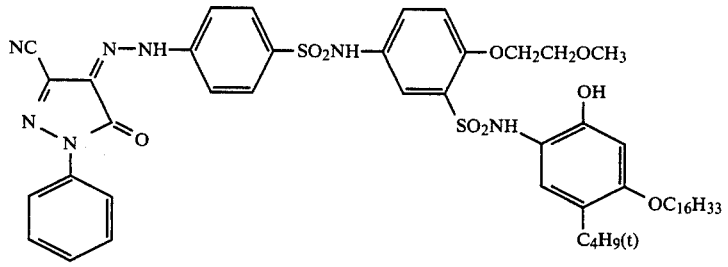

(2)

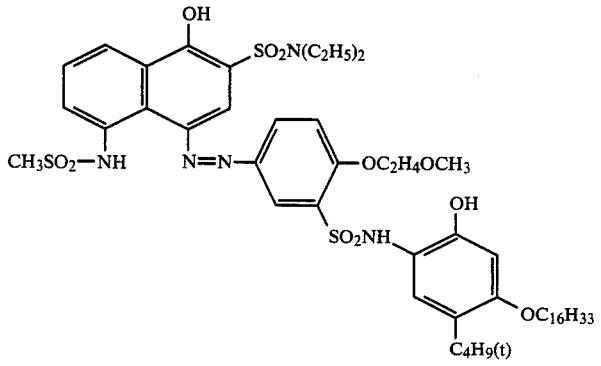

-continued
(3)
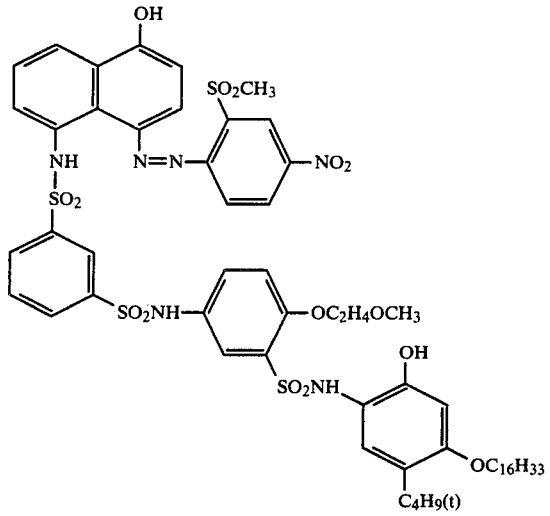
(4)
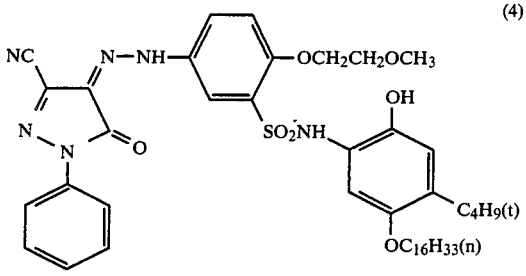
(5)
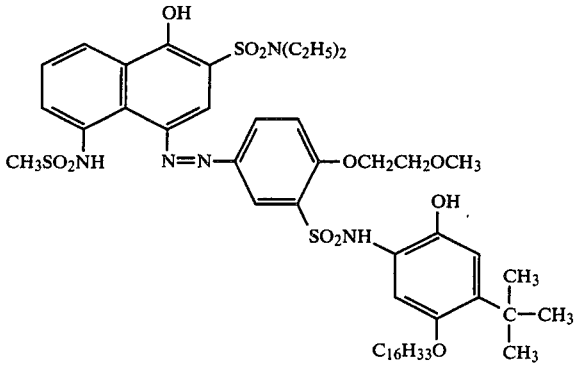
(6)
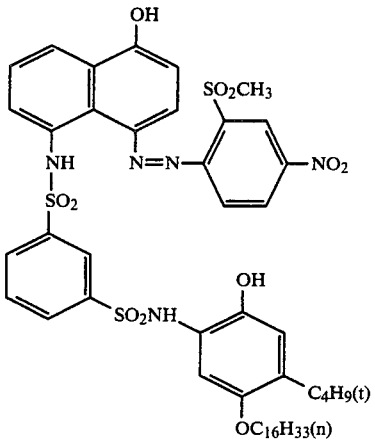
(7)
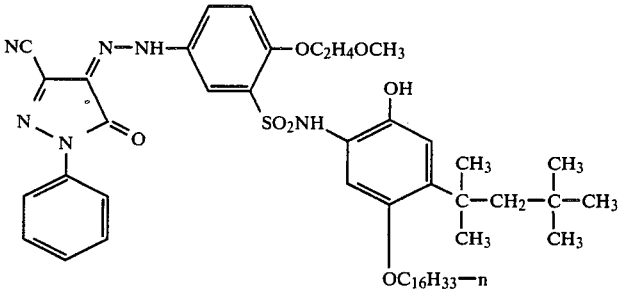
(8)
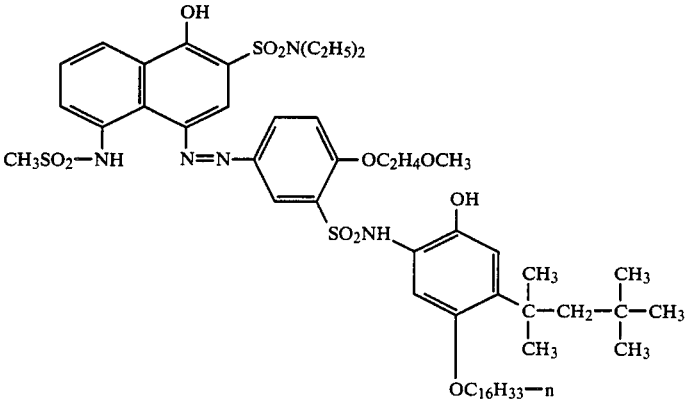

-continued
(9)
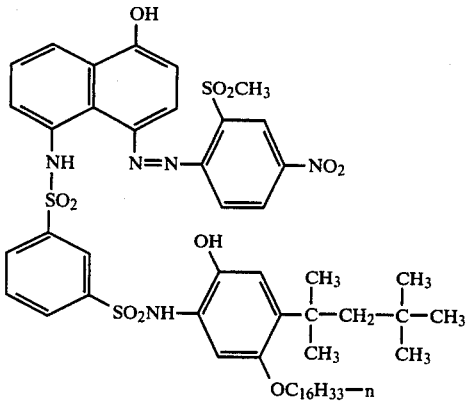
(10)
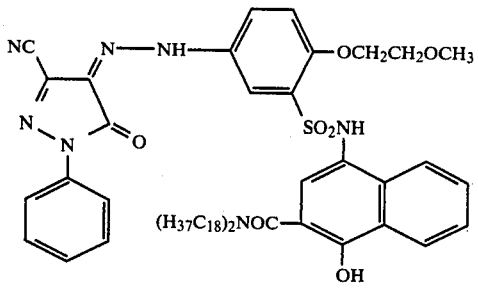
(11)
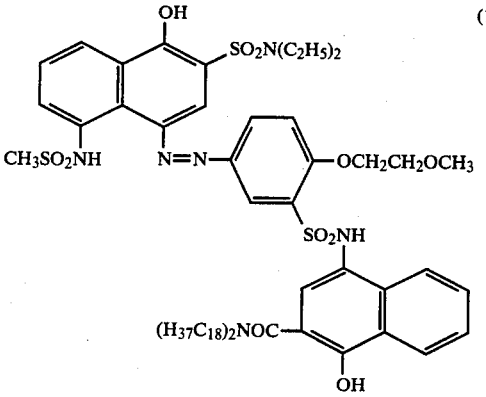
(12)
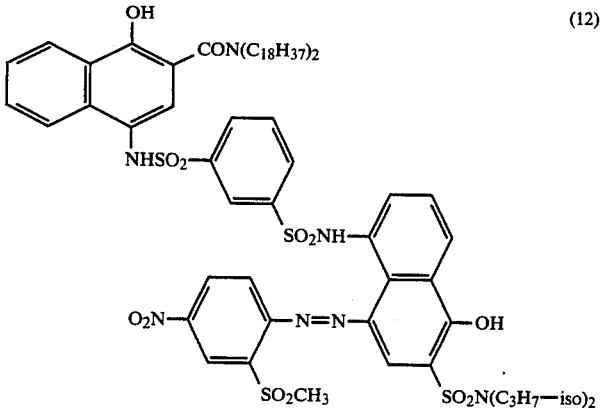
(13)
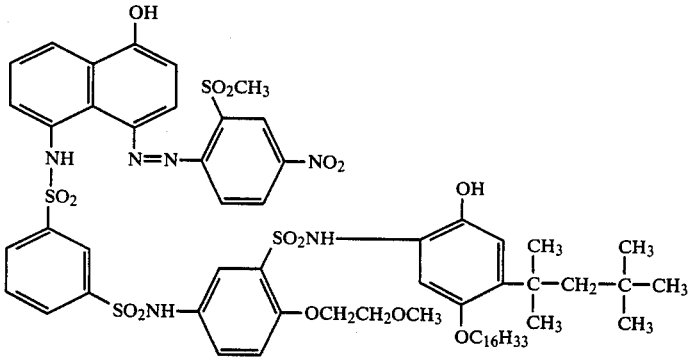
(14)
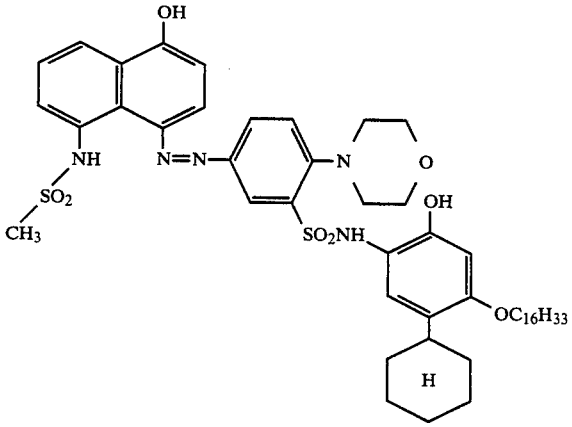

-continued (15)

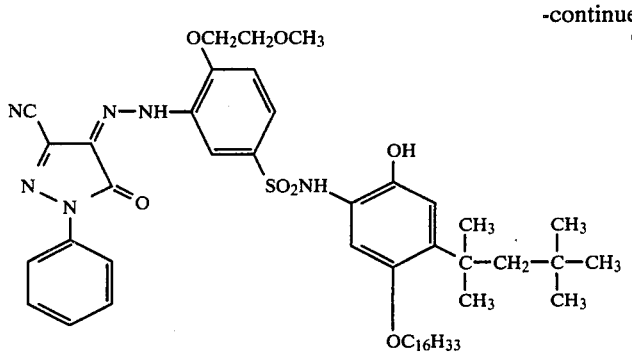

(16)

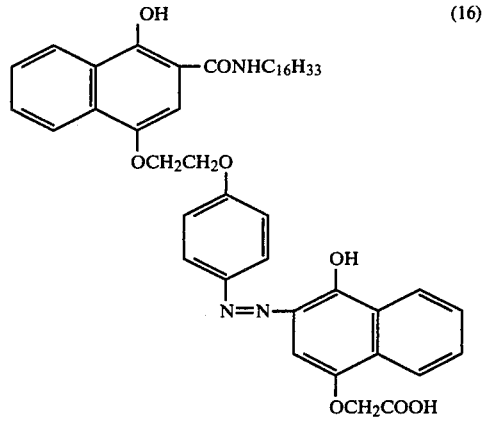

The above described compounds are only given as examples and the present invention should not be construed as being limited thereto.

Most of the dye image forming substance described above form an imagewise distributions of a mobile dye corresponding to exposure in light-sensitive materials by heat development. Methods for transfer of such image forming dyes to dye fixing material (so-called diffusion transfer) to visualize the same are described in the patents cited above.

The dye releasing redox compound used in the present invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye releasing redox compound is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tirubtyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, $\beta$-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye releasing redox compound is dispersed in a hydrophilic colloid. For this purpose, the surface active agents illustrated in other part of the specification can be used.

The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

In the present invention, if necessary, the so-called auxiliary developing agent can be used even when the dye releasing redox compound is used. The auxiliary developing agent in this case is a compound which is oxidized upon the silver halide to form its oxidized product having an ability to oxidize the reducing group Ra in the dye releasing redox compound.

Examples of useful auxiliary developing agents include the compounds specifically described in European Patent Application (OPI) No. 76,492. They can be used in an amount of 0.0005 time by mol to 20 times by mol based on silver.

The silver halide used in the present invention includes silver chloride, silver chlorobromide, silver chloroiodide, silver bromide, silver iodobromide, silver chloroiodobromide and silver iodide, etc.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 $\mu$m to 10 $\mu$m and more preferably from 0.001 $\mu$m to 5 $\mu$m.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T.H. James, *The Theory of the Photographic Process,* The Fourth Edition, Chapter 5, pages 149–169.

In the particularly preferred embodiment of the present invention, an organic silver salt oxidizing agent is used together. The organic silver salt oxidizing agent is a silver salt which forms a silver image by reacting with the above described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the light-sensitive material which provides higher color density can be obtained.

Examples of such organic silver salt oxidizing agents include those described in European Patent Application (OPI) No. 76,492.

A silver salt of an organic compound having a carboxyl group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromo-ethyl-2-thiazolium trichloroacetate, etc., as described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

Various means of exposure can be used in the present invention. Latent images are obtained by image-wise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light-emitting diodes, etc.

In the present invention, after the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above described temperature range.

As the heating means, a simple heat plate, iron, heat roller, heat generator utilizing carbon or titanium white, etc., or analogues thereof may be used.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin- 5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the light-sensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinyl-sulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

The transfer of dyes from the light-sensitive layer to the dye fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of crystallization or microcapsules or as a precursor which releases a solvent at a high temperature.

More preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the intermediate layer, the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes and other heterocyclic compounds.

The present invention will now be illustrated in greater detail with reference to the following examples, but the present invention should not be construed as being limited thereto. Unless otherwise indicated, all parts, percents, ratios and the like are by weight.

EXAMPLE 1

A method of preparing a silver iodobromide emulsion is described in the following.

40 g of gelatin and 26 g of potassium bromide (KBr) were dissolved in 3,000 ml of water and the solution was maintained at 50° C. with stirring. A solution of 34 g of silver nitrate dissolved in 200 ml of water was added to the above prepared solution over 10 minutes. Then, a solution of 3.3 g of potassium iodide (KI) dissolved in 100 ml of water was added over 2 minutes. The thus prepared silver iodobromide emulsion was adjusted in pH, precipitated and freed of excess salts. It was then ajdusted to pH 6.0, whereby 400 g of a silver iodobromide emulsion was obtained.

A method of preparing a silver benzotriazole emulsion is described in the following.

28 g of gelatin and 13.2 g of benzotriazole were dissolved in 3,000 ml of water and the solution was maintained at 40° C. with stirring. A solution of 17 g of silver nitrate dissolved in 100 ml of water was added to the above prepared solution over 2 minutes. The thus prepared silver benzotriazole emulsion was adjusted in pH, precipitated and freed of excess salts. It was then adjusted to pH 6.0, whereby 400 g of a silver benzotriazole emulsion was obtained.

A method of preparing a gelatin dispersion of a dye providing substance is described in the following.

A mixture of 5 g of Dye Providing Substance (8) earlier identified, 0.5 g of succinic acid 2-ethylhexyl ester sulfonic acid sodium salt, 5 g of tricresyl phosphate (TCP) and 30 ml of ethyl acetate was dissolved by heating at about 60° C. This solution was mixed with 100 g of a 10% aqueous solution of gelatin and the mixture was dispersed by means of a homogenizer at 10,000 rpm for 10 minutes. The dispersion thus obtained was designated a dispersion of dye providing substance.

A method of preparing a gelatin dispersion of an acid precursor is described in the following.

5 g of Acid Precursor (1) according to the present invention was added to 10 ml of a 1% aqueous solution of gelatin and the mixture was ground in a mill using 100 g of glass beads having an average diameter of about 0.6 mm for 10 minutes. By removing the glass beads by filtration, a gelatin dispersion of an acid precursor was obtained.

In the following, methods of preparing Light-Sensitive Materials A and B using the above materials are described.

| Light-Sensitive Material A | | |
|---|---|---|
| (a) | Silver iodobromide emulsion | 20 g |
| (b) | Silver benzotriazole emulsion | 10 g |
| (c) | Dispersion of Dye Providing substance (8) | 33 g |
| (d) | 5% Aqueous solution of a compound having the following formula: 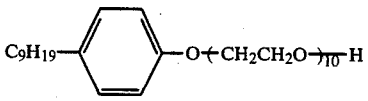 | 10 ml |
| (e) | 10% Aqueous solution of a compound having the following formula: $H_2NSO_2N(CH_3)_2$ | 4 ml |
| (f) | Solution containing 1.6 g of guanidine trichloroacetate (a base precursor) dissolved in 16 ml of ethanol | |
| (g) | Gelatin dispersion of Acid Precursor (1) according to the present invention | 10 ml |

The above components (a) to (g) were mixed and dissolved by heating and the mixture was coated on a polyethylene terephthalate film having a thickness of 180 μm at a wet layer thickness of 33 μm and then dried. On the thus formed layer, a solution having the following composition was coated at a wet layer thickness of 30 μm and dried to form a protective layer, whereupon Light-Sensitive Material A was prepared.

| | | |
|---|---|---|
| (a) | 10% Aqueous solution of gelatin | 30 ml |
| (b) | Water | 70 ml |
| Light-Sensitive Material B | | |
| (a) | Silver iodobromide emulsion | 20 g |
| (b) | Silver benzotriazole emulsion | 10 g |
| (c) | Dispersion of Dye Providing Substance (8) | 33 g |
| (d) | 5% Aqueous solution of a compound having the following formula: 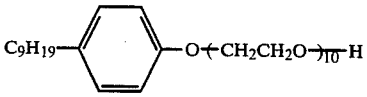 | 10 ml |
| (e) | 10% Aqueous solution of a compound having the following formula: $H_2NSO_2N(CH_3)_2$ | 4 ml |
| (f) | Solution containing 1.6 g of guanidine trichloroacetate (a base precursor) dissolved in 16 ml of ethanol | |
| (g) | Water | 10 ml |

The above components (a) to (g) were mixed and dissolved by heating and the mixture was coated on a polyethylene terephthalate film having a thickness of 180 μm at a wet layer thickness of 33 μm and dried. On the thus formed layer, the protective layer was provided in the same manner as described for Light-Sensitive Material A.

A method of preparing an image receiving material having an image receiving layer is described in the following.

10 g of a methyl acrylate/N,N,N-trimethyl-N-vinylbenzylammonium chloride (1:1 by mol) copolymer was dissolved in 200 ml of water and then uniformly mixed with 100 g of a 10% aqueous solution of lime processed gelatin. The resulting mixture was uniformly coated at a wet layer thickness of 90 μm on a paper support laminated with polyethylene with titanium dioxide dispersed therein. The thus produced material was dried and then used as an image receiving material.

Light-Sensitive Materials A and B thus obtained were each imagewise exposed for 10 seconds at 2,000 lux using a tungsten lamp and then uniformly heated for 30 seconds or 40 seconds on a heat block heated at 140° C.

The image receiving material was soaked in water and then superimposed on each of the above heated Light-Sensitive Materials A and B in such a manner that their coated layers were in contact with each other.

After heating for 6 seconds on a heated block maintained at 80° C., the image receiving material was separated from the light-sensitive material, whereupon a negative magenta color image was obtained in the image receiving material.

Negative image density was measured by means of a Macbeth reflective densitometer (RD-519). The results thus obtained are shown in Table 1.

TABLE 1

| Light-Sensitive Material | Heating at 140° C. for 30 Seconds | | Heating at 140° C. for 40 Seconds | |
|---|---|---|---|---|
| | Maximum Density | Minimum Density | Maximum Density | Minimum Density |
| A (Present Invention) | 1.97 | 0.08 | 2.05 | 0.10 |
| B (Comparison) | 2.15 | 0.15 | 2.20 | 0.28 |

It is apparent from the results shown in Table 1 that the increases in the maximum density and minimum density are small even when the developing time is extended 10 minutes due to the use of the acid precursor according to the present invention. On the contrary, in the comparative sample which did not contain the acid precursor, a remarkable increase of fog was observed. Therefore, it can be understood that the acid precursor according to the present invention has a large effect on stopping development.

EXAMPLE 2

In this example, cases where a silver benzotriazole emulsion is not used are illustrated.

A method of preparing Light-Sensitive Materials C and D is described in the following.

| Light-Sensitive Material C | | |
|---|---|---|
| (a) | Light-sensitive silver iodobromide emulsion (the same as described in Example 1) | 25 g |
| (b) | Dispersion of Dye Providing Substance (8) (the same as described in Example 1) | 33 g |
| (c) | 5% Aqueous solution of a compound having the following formula: | 10 ml |

-continued

Light-Sensitive Material C

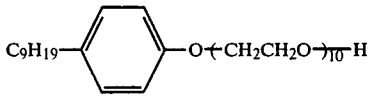

| | | |
|---|---|---|
| (d) | 10% Aqueous solution of a compound having the following formula: $H_2NSO_2N(CH_3)_2$ | 4 ml |
| (e) | Solution containing 1.5 g of guanidine trichloroacetate dissolved in 15 ml of ethanol | |
| (f) | Gelatin dispersion of Acid Precursor (1) according to the present invention (the same as described in Example 1) | 10 ml |

The above components (a) to (f) were mixed and dissolved by heating and the mixture was coated on a polyethylene terephthalate film having a thickneas of 180 μm at a wet layer thickness of 33 μm and then dried. On the thus formed layer, a solution having the following composition was coated at a wet layer thickness of 30 μm and dried to form a protective layer, whereupon Light-Sensitive Material C was prepared.

| | | |
|---|---|---|
| (a) | 10% Aqueous solution of gelatin | 30 ml |
| (b) | Water | 70 ml |

Light-Sensitive Material D

| | | |
|---|---|---|
| (a) | Light-sensitive silver iodobromide emulsion (the same as described in Example 1) | 25 g |
| (b) | Dispersion of Dye Providing Substance (8) (the same as described in Example 1) | 33 g |
| (c) | 5% Aqueous solution of a compound having the following formula: | 10 ml |

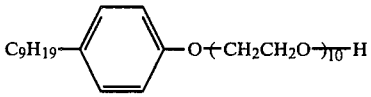

| | | |
|---|---|---|
| (d) | 10% Aqueous solution of a compound having the following formula: $H_2NSO_2N(CH_3)_2$ | 4 ml |
| (e) | Solution containing 1.5 g of guanidine trichloroacetate dissolved in 15 ml of ethanol | |
| (f) | Water | 10 ml |

The above components (a) to (f) were mixed and dissolved by heating and the mixture was coated on a polyethylene terephthalate film having a thickness of 180 μm at a wet layer thickness of 33 μm and dried. On the thus formed layer, the protective layer was provided in the same manner as described for Light-Sensitive Material C. Light-Sensitive Materials C and D thus obtained were subjected to the same procedures as described in Example 1 and the results shown in Table 2 were obtained.

TABLE 2

| Light-Sensitive Material | Heating at 140° C. for 30 Seconds | | Heating at 140° C. for 40 Seconds | |
|---|---|---|---|---|
| | Maximum Density | Minimum Density | Maximum Density | Minimum Density |
| C (Present Invention) | 1.85 | 0.12 | 1.95 | 0.18 |
| D (Comparison) | 2.00 | 0.20 | 2.18 | 0.37 |

As is apparent from the results shown in Table 2, a large effect on stopping development was obtained by using the acid precursor according to the present invention.

EXAMPLE 3

Light-Sensitive Materials E to G were prepared in the same manner as described for Light-Sensitive Material A of Example 1 except using the acid precursors shown in Table 3 below in place of Acid Precursor (1), respectively, and subjected to the same procedures as described in Example 1. The results thus obtained are shown in Table 3.

TABLE 3

| Light-Sensitive Material | Acid Precursor | Heating at 140° C. for 30 Seconds | | Heating at 140° C. for 40 Seconds | |
|---|---|---|---|---|---|
| | | Maximum Density | Minimum Density | Maximum Density | Minimum Density |
| E (Present Invention) | (26) | 1.90 | 0.08 | 1.98 | 0.12 |
| F (Present Invention) | (30) | 2.04 | 0.12 | 2.15 | 0.15 |
| G (Present Invention) | (38) | 2.00 | 0.10 | 2.11 | 0.13 |
| B (Comparison, same as in Example 1) | None | 2.15 | 0.15 | 2.20 | 0.28 |

From the results shown in Table 3 it can be understood that the acid precursors according to the present invention exhibit excellent effects on stopping development.

EXAMPLE 4

Dispersions of dye providing substances were prepared in the same manner as described in Example 1 except using the dye providing substances shown in Table 4 below in place of Dye Providing Substance (8), respectively.

| | | |
|---|---|---|
| Dye Providing Substance (5) | 5 g | Dispersion (I) |
| Dye Providing Substance (7) | 7.5 g | Dispersion (II) |
| Dye Providing Substance (6) | 5 g | Dispersion (III) |

Light-Sensitive Materials H, J and L were prepared in the same manner as described for Light-Sensitive Material A of Example 1 except using the dye providing substances as described above in place of Dye Providing Substance (8), respectively. Further, Light-Sensitive Materials I, K and M were prepared in the same manner as described for Light-Sensitive Material B of Example 1 except using the dye providing substances as described above in place of Dye Providing Substance (8), respectively. The light-sensitive materials thus obtained were subjected to the same procedures as described in Example 1 and the results shown in Table 4 were obtained.

TABLE 4

| Light-Sensitive Material | Dispersion of Dye Providing Substance | Acid Precursor | Heating at 140° C. for 30 Seconds | | Heating at 140° C. for 40 Seconds | |
|---|---|---|---|---|---|---|
| | | | Maximum Density | Minimum Density | Maximum Density | Minimum Density |
| H (Present Invention) | Dispersion (I) (magenta) | (1) | 1.98 | 0.14 | 2.04 | 0.23 |
| I (Comparison) | Dispersion (I) (magenta) | None | 2.25 | 0.20 | 2.32 | 0.42 |
| J (Present Invention) | Dispersion (II) (yellow) | (1) | 1.80 | 0.15 | 1.92 | 0.25 |
| K (Comparison) | Dispersion (II) (yellow) | None | 1.95 | 0.22 | 2.02 | 0.46 |
| L (Present Invention) | Dispersion (III) (cyan) | (1) | 2.04 | 0.15 | 2.10 | 0.21 |
| M (Comparison) | Dispersion (III) (cyan) | None | 2.30 | 0.20 | 2.34 | 0.38 |

From the results shown in Table 4 it can be understood that the acid precursor according to the present invention exhibits excellent effects on stopping development.

EXAMPLE 5

In this example the base precursors as described below were used in place of guanidine trichloroacetate in Example 1, respectively.

Base Precursor I:

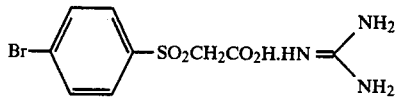

Base Precursor II:

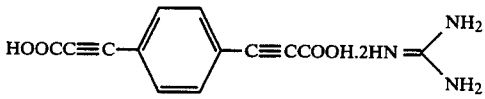

Light-Sensitive Material N:

| | | |
|---|---|---|
| (a) | Silver iodobromide emulsion (the same as described in Example 1) | 20 g |
| (b) | Silver benzotriazole emulsion (the same as described in Example 1) | 10 g |
| (c) | Dispersion of Dye Providing Substance (8) (the same as described in Example 1) | 33 g |
| (d) | 5% Aqueous solution of a compound having the following formula: 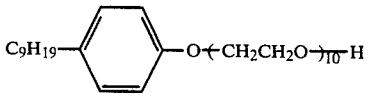 | 10 ml |
| (e) | 10% Aqueous solution of a compound having the following formula: $H_2NSO_2N(CH_3)_2$ | 4 ml |
| (f) | 8% Water-methanol (1:1 by volume) solution of Base Precursor I | 32 ml |
| (g) | Gelatin dispersion of Acid Precursor (1) according to the present invention (the same as described in Example 1) | 10 ml |

The above components (a) to (g) were mixed and dissolved by heating and the mixture was coated on a polyethylene terephthalate film having a thickness of 180 μm at a wet layer thickness of 38 μm and then dried. On the thus formed layer, a solution having the following composition was coated at a wet layer thickness of 30 μm and dried to form a protective layer, whereupon Light-Sensitive Material N was prepared.

| | | |
|---|---|---|
| (a) | 10% Aqueous solution of gelatin | 30 ml |
| (b) | Water | 70 ml |

Light-Sensitive Material O:

| | | |
|---|---|---|
| (a) | Silver iodobromide emulsion (the same as described in Example 1) | 20 g |
| (b) | Silver benzotriazole emulsion (the same as described in Example 1) | 10 g |
| (c) | Dispersion of Dye Providing Substance (8) (the same as described in Example 1) | 33 g |
| (d) | 5% Aqueous solution of a compound having the following formula: 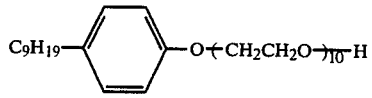 | 10 ml |
| (e) | 10% Aqueous solution of a compound having the following formula: $H_2NSO_2N(CH_3)_2$ | 4 ml |
| (f) | 8% Water-methanol (1:1 by volume) solution of Base Precursor I | 32 ml |
| (g) | Water | 10 ml |

The above components (a) to (g) were mixed and dissolved by heating and the mixture was coated on a polyethylene terephthalate film having a thickness of 180 μm at a wet layer thickness of 38 μm and then dried. On the thus formed layer, the protective layer was provided in the same manner as described for Light-Sensitive Material N.

Light-Sensitive Material P:

| | | |
|---|---|---|
| (a) | Silver iodobromide emulsion (the same as described in Example 1) | 20 g |
| (b) | Silver benzotriazole emulsion (the same as described in Example 1) | 10 g |
| (c) | Dispersion of Dye Providing Substance (8) (the same as described in Example 1) | 33 g |
| (d) | 5% Aqueous solution of a compound having the following formula: 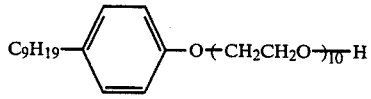 | 10 ml |
| (e) | 10% Aqueous solution of a compound having the following formula: $H_2NSO_2N(CH_3)_2$ | 4 ml |
| (f) | 8% Water-methanol (1:1 by volume) of Base Precursor II | 32 ml |
| (g) | Gelatin dispersion of Acid Precursor (1) according to the present invention (the same as described in Example 1) | 10 ml |

The above components (a) to (g) were mixed and dissolved by heating and the mixture was coated on a polyethylene terephthalate film having a thickness of 180 μm at a wet layer thickness of 38 μm and then dried. On the thus formed layer, a solution having the following composition was coated at a wet layer thickness of 30 μm and dried to form a protective layer, whereupon Light-Sensitive Material P was prepared.

| | | |
|---|---|---|
| (a) | 10% Aqueous solution of gelatin | 30 ml |
| (b) | Water | 70 ml |
| Light-Sensitive Material Q: | | |
| (a) | Silver iodobromide emulsion (the same as described in Example 1) | 20 g |
| (b) | Silver benzotriazole emulsion (the same as described in Example 1) | 10 g |
| (c) | Dispersion of Dye Providing Substance (8) (the same as described in Example 1) | 33 g |
| (d) | 5% Aqueous solution of a compound having the following formula: 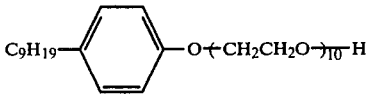 | 10 ml |
| (e) | 10% Aqueous solution of a compound having the following formula: $H_2NSO_2N(CH_3)_2$ | 4 ml |
| (f) | 8% Water-methanol (1:1 by volume) solution of Base Precursor II | 32 ml |
| (g) | Water | 10 ml |

The above components (a) to (g) were mixed and dissolved by heating and the mixture was coated on a polyethylene terephthalate film having a thickness of 180 μm at a wet layer thickness of 38 μm and then dried. On the thus formed layer, the protective layer was provided in the same manner as described for Light-Sensitive Material P.

Light-Sensitive Materials N, O, P and Q thus obtained were subjected to the same procedures as described in Example 1 and the results shown in Table 5 were obtained.

TABLE 5

| Light-Sensitive Material | Base Precursor | Acid Precursor | Heating at 140° C. for 30 Seconds | | Heating at 140° C. for 40 Seconds | |
|---|---|---|---|---|---|---|
| | | | Maximum Density | Minimum Density | Maximum Density | Minimum Density |
| N (Present Invention) | I | (1) | 1.72 | 0.08 | 1.79 | 0.14 |
| O (Comparison) | I | None | 1.80 | 0.12 | 1.92 | 0.26 |
| P (Present Invention) | II | (1) | 2.00 | 0.10 | 2.07 | 0.18 |
| Q (Comparison) | II | None | 2.15 | 0.14 | 2.21 | 0.32 |

As is apparent from the results shown in Table 5, a large effect on stopping development was obtained by using the acid precursor according to the present invention.

EXAMPLE 6

| | | |
|---|---|---|
| Light-Sensitive Material R: | | |
| (a) | Silver iodobromide emulsion (the same as described in Example 1) | 20 g |
| (b) | Silver benzotriazole emulsion (the same as described in Example 1) | 10 g |
| (c) | Dispersion of Dye Providing Substance (8) (the same as described in Example 1) | 33 g |
| (d) | 5% Aqueous solution of a compound having the following formula: 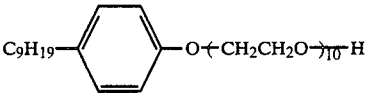 | 10 ml |
| (e) | 10% Aqueous solution of a compound having the following formula: $H_2NSO_2N(CH_3)_2$ | 4 ml |
| (f) | Solution containing 0.8 g of guanidine trichloroacetate (a base precursor) dissolved in 8 ml of ethanol | |
| (g) | Gelatin dispersion of Acid Precursor (1) according to the present invention (the same as described in Example 1) | 5 ml |
| (h) | Water | 13 ml |

The above components (a) to (h) were mixed and dissolved by heating and the mixture was coated on a polyethylene terephthalate film having a thickness of 180 μm at a wet layer thickness of 33 μm and then dried. On the thus formed layer, a solution having the following composition was coated at a wet layer thickness of 30 μm and dried to form a protective layer, whereupon Light-Sensitive Material R was prepared.

| | | |
|---|---|---|
| (a) | 10% Aqueous solution of gelatin | 30 ml |
| (b) | Water | 56 ml |
| (c) | Solution containing 0.9 g of guanidine trichloroacetate dissolved in 9 ml of ethanol | |
| (d) | Gelatin dispersion of Acid Precursor (1) according to the present invention (the same as described in Example 1) | 5 ml |
| Light-Sensitive Material S: | | |
| (a) | Silver iodobromide emulsion (the same as described in Example 1) | 20 g |
| (b) | Silver benzotriazole emulsion (the same as described in Example 1) | 10 g |
| (c) | Dispersion of Dye Providing Substance (8) (the same as described in Example 1) | 33 g |
| (d) | 5% Aqueous solution of a compound having the following formula: 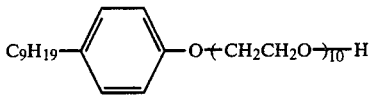 | 10 ml |
| (e) | 10% Aqueous solution of a compound having the following formula: $H_2NSO_2N(CH_3)_2$ | 4 ml |
| (f) | Solution containing 0.8 g of guanidine trichloroacetate (a base precursor) dissolved in 8 ml of ethanol | |
| (g) | Water | 18 ml |

The above components (a) to (g) were mixed and dissolved by heating and the mixture was coated on a polyethylene terephthalate film having a thickness of 180 μm at a wet layer thickness of 33 μm and then dried. On the thus formed layer, a solution having the following composition was coated at a wet layer thickness of 30 μm and dried to form a protective layer, whereupon Light-Sensitive Material S was prepared.

| | | |
|---|---|---|
| (a) | 10% Aqueous solution of gelatin | 30 ml |
| (b) | Water | 61 ml |

-continued

| | |
|---|---|
| (c) | Solution containing 0.9 g of guanidine trichloroacetate dissolved in 9 ml of ethanol |

Light-Sensitive Materials R and S thus obtained were subjected to the same procedures as described in Example 1 and the results shown in Table 6 were obtained.

TABLE 6

| Light-Sensitive Material | Heating at 140° C. for 30 Seconds | | Heating at 140° C. for 40 Seconds | |
|---|---|---|---|---|
| | Maximum Density | Minimum Density | Maximum Density | Minimum Density |
| R (Present Invention) | 2.02 | 0.10 | 2.09 | 0.14 |
| S (Comparison) | 2.10 | 0.12 | 2.19 | 0.38 |

It can be understood from the results shown in Table 6 that the acid precursor according to the present invention has a large effect on stopping development when it is incorporated into a protective layer of a light-sensitive material.

EXAMPLE 7

A mixture of 10 g of Dye Providing Substance (16), 0.5 g of succinic acid 2-ethylhexyl ester sulfonic acid sodium salt, 10 g of tricresyl phosphate and 20 μml of cyclohexanone was dissolved by heating at 60° C. to prepare a uniform solution. The solution was mixed with 100 g of a 10% aqueous solution of lime processed gelatin by stirring and the mixture was dispersed by means of a homogenizer to prepare a dispersion of dye providing substance.

Light-Sensitive Material 701 was prepared in the following manner.

| | | |
|---|---|---|
| (a) | Silver iodobromide emulsion (the same as described in Example 1) | 5.5 g |
| (b) | 10% Aqueous solution of gelatin | 0.5 g |
| (c) | Dispersion of Dye Providing Substance (16) (described above) | 2.5 g |
| (d) | 10% Ethanol solution of guanidine trichloroacetate | 1 ml |
| (e) | 10% Methanol solution of 2,6-dichloro-4-aminophenol | 0.5 ml |
| (f) | 5% Aqueous solution of a compound having the following formula: 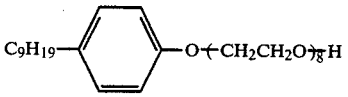 | 1 ml |
| (g) | Gelatin dispersion of Acid Precursor (1) according to the present invention (the same as described in Example 1) | 0.5 g |
| (h) | Water | 6 ml |

The above components (a) to (h) were mixed and dissolved by heating and the mixture was coated on a polyethylene terephthalate film at a wet layer thickness of 85 μm and dried. On the thus formed layer, a protecting layer containing 1.5 g/m$^2$ of gelatin was provided and dried, whereupon Light-Sensitive Material 701 was prepared.

Light-Sensitive Material 701 thus obtained was subjected to light exposure and processing in the same manner as described in Example 1 and the results shown in Table 7 were obtained.

TABLE 7

| Light-Sensitive Material | Heating at 140° C. for 30 Seconds | | Heating at 140° C. for 40 Seconds | |
|---|---|---|---|---|
| | Maximum Density | Minimum Density | Maximum Density | Minimum Density |
| 701 | 1.62 | 0.09 | 1.71 | 0.15 |

From the results shown in Table 7 it can be recognized that the acid precursor according to the present invention also exhibits the remarkable effects of the present invention in a light-sensitive material containing a dye providing substance which releases a dye upon coupling reaction with the oxidation product of a developing agent.

EXAMPLE 8

A mixture of 5 g of Dye Providing Substance (17) having the structure shown below, 4 g of an electron donor having the structure shown below, 0.5 g of succinic acid 2-ethylhexyl ester sulfonic acid sodium salt, 10 g of tricresyl phosphate and 20 ml of cyclohexanone was dissolved by heating at about 60° C. Then, the same procedure as described in Example 7 was carried out to prepare a dispersion of dye providing substance capable of being reduced.

Dye Providing Substance (17):

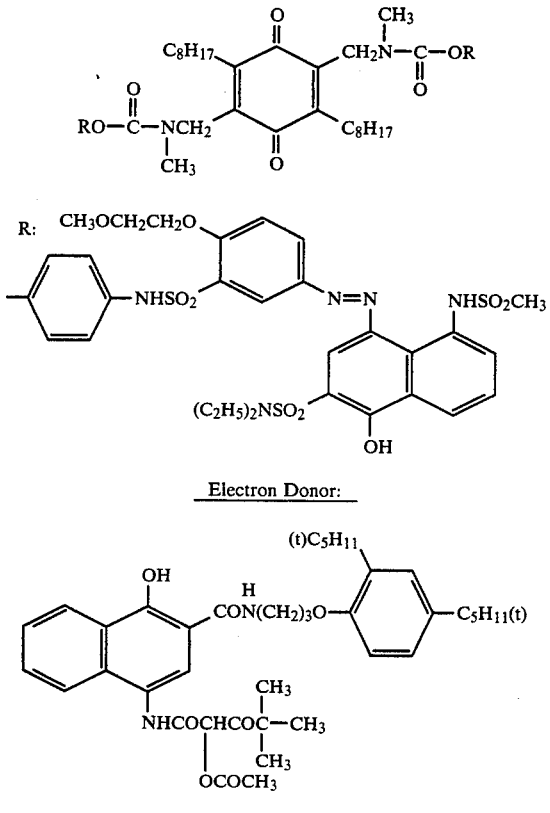

Light-Sensitive Material 801 was prepared in the same manner as described for Light-Sensitive Material 701 in Example 7 except using the above described dispersion of dye providing substance capable of being reduced in place of the dispersion of Dye Providing Substance (16) and the indicated amount of the electron donor.

Light-Sensitive Material 801 thus obtained was subjected to light exposure and processing in the same manner as described in Example 1 and the results shown in Table 8 was obtained.

TABLE 8

| Light-Sensitive Material | Heating at 140° C. for 30 Seconds | | Heating at 140° C. for 40 Seconds | |
|---|---|---|---|---|
| | Maximum Density | Minimum Density | Maximum Density | Minimum Density |
| 801 | 1.50 | 0.12 | 1.56 | 0.19 |

From the results shown in Table 8 it can be recognized that the acid precursor according to the present invention also exhibits good effect in a light-sensitive material containing a dye providing substance which is capable of being reduced and providing a positive image with respect to a silver image.

EXAMPLE 9

A method of preparing a gelatin dispersion of a coupler is described in the following.

A mixture of 5 g of 2-dodecylcarbamoyl-1-naphthol (Dye Providing Substance (18)), 0.5 g of succinic acid 2-ethylhexyl ester sulfonic acid sodium salt, 2.5 g of tricresyl phosphate (TCP) and 30 ml of ethyl acetate was dissolved. The solution was mixed with 100 g of a 10% aqueous solution of gelatin by stirring and the mixture was dispersed by means of a homogenizer at 10,000 rpm for 10 minutes.

Light-Sensitive Material 901 was prepared in the following manner.

| | | |
|---|---|---|
| (a) | Silver iodobromide emulsion (the same as described in Example 1) | 10 g |
| (b) | Gelatin dispersion of coupler (described above) | 3.5 g |
| (c) | Solution containing 0.25 g of guanidine trichloroacetate dissolved in 2.5 ml of ethanol | |
| (d) | 10% Aqueous solution of gelatin | 5 g |
| (e) | Solution containing 0.2 g of 2,6-dichloro-p-aminophenol dissolved in 15 ml of water | |
| (f) | Gelatin dispersion of Acid Precursor (1) according to the present invention (the same as described in Example 1) | 2 ml |

A coating solution having the composition shown above was coated on a polyethylene terephthalate film support at a wet layer thickness of 60 μm and dried, whereupon Light-Sensitive Material 901 was prepared.

Light-Sensitive Material 901 thus obtained was imagewise exposed for 5 seconds at 2,000 lux using a tungsten lamp and then uniformly heated for 20 seconds or 30 seconds on a heated block heated at 150° C., whereupon a negative cyan color image was obtained.

Negative image density was measured by means of a Macbeth transmission densitometer (TD-504). The results thus obtained are shown in Table 9.

TABLE 9

| Light-Sensitive Material | Heating at 150° C. for 20 Seconds | | Heating at 150° C. for 30 Seconds | |
|---|---|---|---|---|
| | Maximum Density | Minimum Density | Maximum Density | Minimum Density |
| 901 | 1.85 | 0.18 | 1.93 | 0.29 |

From the results shown in Table 9 it can be understood that the acid precursor according to the present invention exhibits a large effect on stopping development.

EXAMPLE 10

In this example, a black-and-white system is illustrated.

Light-Sensitive Material 1001 was prepared in the following manner.

| | | |
|---|---|---|
| (a) | Silver iodobromide emulsion (the same as described in Example 1) | 1 g |
| (b) | Silver benzotriazole emulsion (the same as described in Example 1) | 10 g |
| (c) | 10% Ethanol solution of guanidine trichloroacetate | 1 ml |
| (d) | 5% Methanol solution of a compound having the following formula: 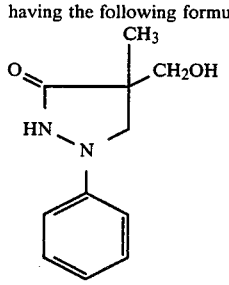 | 2 ml |
| (e) | Gelatin dispersion of Acid Precursor (1) according to the present invention (the same as described in Example 1) | 1 ml |

A coating solution having the composition shown above was coated on a polyethylene terephthalate film support at a wet layer thickness of 60 μm and dried, whereupon Light-Sensitive Material 1001 was prepared.

Light-Sensitive Material 1001 thus obtained was imagewise exposed for 5 seconds at 2,000 lux using a tungsten lamp and then uniformly heated for 30 seconds or 40 seconds on a heated block heated at 130° C., whereupon a negative brown image was obtained.

Negative image density was measured by means of a Macbeth transmission densitometer (TR-504). The results thus obtained are shown in Table 10.

TABLE 10

| Light-Sensitive Material | Heating at 130° C. for 30 Seconds | | Heating at 130° C. for 40 Seconds | |
|---|---|---|---|---|
| | Maximum Density | Minimum Density | Maximum Density | Minimum Density |
| 1001 | 0.68 | 0.12 | 0.75 | 0.21 |

From the results shown in Table 10 it can be understood that the acid precursor according to the present invention exhibited the large effect on stopping development.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material comprising a support having thereon at least one light-sensitive silver halide emulsion, a reducing substance and an acid precursor having a structural moiety represented by the following formula (I) bonded to carbon atoms;

$$-\overset{O}{\overset{\|}{C}}-NH-O-\overset{O}{\overset{\|}{C}}- \quad (I)$$

, said acid precursor being capable of releasing a carboxylic acid when heated.

2. A heat-developable light-sensitive material as claimed in claim 1, wherein the acid precursor is a compound represented by the following general formula (A):

$$(R^1-\overset{O}{\overset{\|}{C}}-\overset{H}{\overset{|}{N}}-O-\overset{O}{\overset{\|}{C}})_n-R^2$$

wherein $R^1$ represents a group selected from an alkyl group, a cycloalkyl group, an aralkyl group, an alkenyl group, an aryl group, and a heterocyclic group; $R^2$ represents a mono-, di- or trivalent group selected from an alkyl group, a cycloalkyl group, an aralkyl group, an aryl group, and a heterocyclic group; and n represents an integer of 1, 2 or 3.

3. A heat-developable light-sensitive material as claimed in claim 2, wherein the alkyl group represented by $R^1$ or $R^2$ is a straight chain or branched chain unsubstituted or substituted alkyl group having from 1 to 18 carbon atoms.

4. A heat-developable light-sensitive material as claimed in claim 3, wherein a substituent for the substituted alkyl group represented by $R^1$ or $R^2$ is selected from a halogen atom, an alkoxy group, a cyano group, a carbamoyl group, a hydroxy group and a carboxy group.

5. A heat-developable light-sensitive material as claimed in claim 2, wherein the cycloalkyl group represented by $R^1$ or $R^2$ is a 5-membered or 6-membered unsubstituted or substituted cycloalkyl group having from 5 to 10 carbon atoms.

6. A heat-developable light-sensitive material as claimed in claim 2, wherein the aryl group represented by $R^1$ or $R^2$ is an unsubstituted or substituted aryl group having from 6 to 18 carbon atoms.

7. A heat-developable light-sensitive material as claimed in claim 6, wherein a substituent for the substituted aryl group represented by $R^1$ or $R^2$ is selected from a substituted or unsubstituted alkyl group, a substituted or unsubstituted alkoxy group, a substituted or unsubstituted aryl group, a halogen atom, a hydroxy group, a mercapto group, an amino group, a substituted amino group substituted with an alkyl group or an aryl group, an acylamino group, a sulfonylamino group, a cyano group, a nitro group, an alkyl- or arylthio group, an alkyl- or arylsulfonyl group, an oxycarbonyl group, a carbonyloxy group, a substituted or unsubstituted carbamoyl group, and a substituted or unsubstituted sulfamoyl group.

8. A heat-developable light-sensitive material as claimed in claim 2, wherein the heterocyclic group represented by $R^1$ or $R^2$ is a pyridyl group, a furyl group, a thienyl group, a pyrrole group or an indolyl group.

9. A heat-developable light-sensitive material as claimed in claim 2, wherein the heterocyclic group represented by $R^1$ or $R^2$ is a substituted heterocyclic group having a substituent selected from a substituted or unsubstituted alkyl group, a substituted or unsubstituted alkoxy group, a substituted or unsubstituted aryl group, a halogen atom, a hydroxy group, a mercapto group, an amino group, a substituted amino group substituted with an alkyl group or an aryl group, an acylamino group, a sulfonylamino group, a cyano group, a nitro group, an alkyl- or arylthio group, an alkyl- or arylsulfonyl group, an oxycarbonyl group, a carbonyloxy group, a substituted or unsubstituted carbamoyl group, and a substituted or unsubstituted sulfamoyl group.

10. A heat-developable light-sensitive material as claimed in claim 1, wherein the amount of the acid precursor is from 0.01% to 50% by weight based on the total weight of the coated layers on the support.

11. A heat-developable light-sensitive material as claimed in claim 1, wherein the light-sensitive material further contains a dye releasing assistant selected from a base and a base precursor.

12. A heat-developable light-sensitive material as claimed in claim 11, wherein the base precursor is a substance which released a base component by heating, wherein the base component is selected from an inorganic base and an organic base.

13. A heat-developable light-sensitive material as claimed in claim 12, wherein the inorganic base is a compound selected from hydroxides, secondary or tertiary phosphates, borates, carbonates, quinolinates and metaborates of alkali metals or alkaline earth metals, ammonium hydroxides, quaternary alkylammonium hydroxides and hydroxides of other metals.

14. A heat-developable light-sensitive material as claimed in claim 12, wherein tne organic base is a compound selected from aliphatic amines, aromatic amines, heterocyclic amines, amidines, cyclic amidines, guanidines and cyclic guanidines.

15. A heat-developable light-sensitive material as claimed in claim 11, wherein the amount of the base or base precursor is not more than 50% by weight based on the total weight of the coated layers on the support.

16. A heat-developable light-sensitive material as claimed in claim 1, wherein the light-sensitive material further contains an image forming substance.

17. A heat-developable light-sensitive material as claimed in claim 16, wherein the image forming substance is a coupler capable of forming a color image upon the reaction with an oxidation product of a developing agent.

18. A heat-developable light-sensitive material as claimed in claim 17, wherein the coupler is a compound selected from 5-pyrazolone couplers, pyrazolobenzimidazole couplers, cyanoacetylcoumarone couplers, open chain acylacetonitrile couplers, acylacetamide couplers, naphthol couplers and phenol couplers.

19. A heat-developable light-sensitive material as claimed in claim 16, wherein the image forming substance is a dye providing substance selected from a compound which releases a mobile dye upon coupling reaction of a reducing agent oxidized by an oxidation-reduction reaction with a silver halide or an organic silver salt at a high temperature, and a compound which releases a mobile dye as a result of an oxidation-reduction reaction with a silver halide or an organic silver salt at high temperature.

20. A heat-developable light-sensitive material as claimed in claim 1, wherein the light-sensitive material further contains an organic silver salt oxidizing agent.

* * * * *